US009663921B2

(12) United States Patent
Wei et al.

(10) Patent No.: US 9,663,921 B2
(45) Date of Patent: May 30, 2017

(54) SYSTEM AND METHOD FOR CONTROLLING OPERATIONS OF A MACHINE

(71) Applicant: Caterpillar Inc., Peoria, IL (US)

(72) Inventors: Mo Wei, Dunlap, IL (US); Michael A. Taylor, Swissvale, PA (US)

(73) Assignee: Caterpillar Inc., Peoria, IL (US)

( * ) Notice: Subject to any disclaimer, the term of this patent is extended or adjusted under 35 U.S.C. 154(b) by 18 days.

(21) Appl. No.: 14/795,402

(22) Filed: Jul. 9, 2015

(65) Prior Publication Data

US 2017/0009426 A1 Jan. 12, 2017

(51) Int. Cl.
*G05D 1/02* (2006.01)
*E02F 9/20* (2006.01)

(52) U.S. Cl.
CPC ..... *E02F 9/2041* (2013.01); *E02F 9/2045* (2013.01)

(58) Field of Classification Search
USPC ..... 37/197, 348, 364; 701/50, 23, 25, 26, 701/36, 400, 41
See application file for complete search history.

(56) References Cited

U.S. PATENT DOCUMENTS 6,068,277 A * 5/2000 Magnussen ..... E02F 9/0833 182/127
8,700,271 B2 4/2014 Evenson et al.
8,788,157 B2 7/2014 Shintani et al.
9,014,925 B2 * 4/2015 Clar ..... E02F 9/2045 239/172
2005/0085947 A1 * 4/2005 Aldred ..... G05D 1/0242 700/253
2007/0168116 A1 * 7/2007 Meyer zu Helligen ..... G01C 21/20 701/50
2012/0116666 A1 * 5/2012 Makela ..... G05D 1/0246 701/400
2012/0136508 A1 * 5/2012 Taylor ..... E02F 9/2045 701/2
2013/0255977 A1 10/2013 Braunstein et al.
2013/0311031 A1 * 11/2013 Friend ..... G05D 1/0278 701/26
2014/0277957 A1 * 9/2014 Clar ..... E02F 5/32 701/50
(Continued)

*Primary Examiner* — Thomas Tarcza
*Assistant Examiner* — Richard Goldman
(74) *Attorney, Agent, or Firm* — Leydig, Voit & Mayer, Ltd.

(57) ABSTRACT

A system for controlling an operation of a machine is provided. The system includes a controller to communicate with a positioning module disposed on the machine and a sensor module associated with the implement. The controller determines a start location and an end location of the operation, and determines an operating path therebetween. Further, the controller engages the implement with a work surface and moves the machine from the start location. The controller further determines an interrupted location of the machine based on the positioning module and a load acting on the implement. The controller further resumes the operation of the machine from the interrupted location if a first distance between the interrupted location and the start location is greater than a first threshold distance and a second distance between the interrupted location and the end location is greater than a second threshold distance.

20 Claims, 4 Drawing Sheets

(56) References Cited

U.S. PATENT DOCUMENTS

| | | | | |
|---|---|---|---|---|
| 2014/0336881 | A1* | 11/2014 | Clar | E02F 9/2045 701/50 |
| 2015/0353080 | A1* | 12/2015 | Mukaiyama | E05B 77/54 701/23 |
| 2016/0091898 | A1* | 3/2016 | Booher | G05D 1/0274 701/26 |
| 2016/0146618 | A1* | 5/2016 | Caveney | G05D 1/06 701/25 |

* cited by examiner

SYSTEM AND METHOD FOR CONTROLLING OPERATIONS OF A MACHINE

TECHNICAL FIELD

The current disclosure relates to an operation of a machine, and more particularly relates to a system and a method for controlling the operation of the machine.

BACKGROUND

A machine, such as a dozer, includes a ripping tool coupled to a rear end of the machine and a cutting tool coupled to a front end of the machine. The ripping tool digs into a work surface for performing a ripping operation. Generally, the machine is operated in a worksite in one of autonomous mode, semi-autonomous mode and a manual mode. In the autonomous mode, the machine is controlled from a center located remotely from the worksite. For ripping operation, the machine is controlled to operate from a start location to an end location in the worksite along a ripping path.

During the ripping operation, at a particular location in the ripping path, the machine may stop and come out of the autonomous mode as the ripping tool may hit on obstacles such as a rock or hard materials. In such a situation, the machine may warn an operator located at the center. Further, the reason for such emergency stoppage of the machine is cleared to perform the ripping operation along the ripping path again. However, if the operator wants to control the machine again in the autonomous mode, the machine may either skip the ripping operation or repeat the ripping operation. This may decrease productivity of the machine and further cause difficulty to the operator to control the machine in the autonomous mode as the operator may not remember the location where the machine is stopped and the start location for the ripping operation.

U.S. Patent Publication Number 2014/0336881 discloses a system for re-orienting a ripping path of a machine during a ripping operation. The system includes a position sensing system, a ripper, and a controller. The system stores a ripping path, determines the position of the machine, and compares the position of the machine to the ripping path. A drawbar pull of the machine is determined, compared to a maximum steering drawbar pull, and the ripper is raised if the machine is positioned greater than a predetermined distance from the ripping path and the drawbar pull exceeds the maximum steering drawbar pull. The machine is re-oriented and the ripper is lowered relative to the work surface.

SUMMARY OF THE DISCLOSURE

In one aspect of the current disclosure, a system for controlling an operation of a machine is provided. The machine includes an implement configured to selectively engage with a work surface to perform the operation. The system includes a positioning module disposed on the machine to determine a location of the machine. The system further includes a sensor module associated with the implement of the machine. The system further includes a controller disposed in communication with the positioning module and the sensor module. The controller is configured to determine a start location and an end location of the operation, and determine an operating path based on the start location and the end location. The controller is further configured to engage the implement with the work surface and move the machine from the start location along the operating path to perform the operation. The controller is further configured to determine a load acting on the implement based on signals received from the sensor module. The controller is further configured to determine an interrupted location of the machine based on signals received from the positioning module and the load acting on the implement. The interrupted location corresponds to a location at which the implement is disengaged from the work surface. The controller is further configured to resume the operation of the machine from the interrupted location if a first distance between the interrupted location and the start location is greater than a first threshold distance and a second distance between the interrupted location and the end location is greater than a second threshold distance.

In another aspect of the current disclosure, a method of controlling an operation of a machine is provided. The machine includes an implement configured to selectively engage with a work surface to perform the operation. The method includes determining a start location and an end location of the operation. The method further includes determining an operating path based on the start location and the end location. The method further includes engaging the implement with the work surface and moving the machine from the start location of the operating path to perform the operation. The method further includes determining an interrupted location of the machine based on signals received from a positioning module and a load acting on the implement. The interrupted location corresponds to a location at which the implement is disengaged from the work surface. The method further includes resuming the operation of the machine from the interrupted location if a first distance between the interrupted location and the start location is greater than a first threshold distance and a second distance between the interrupted location and the end location is greater than a second threshold distance.

In yet another aspect of the current disclosure, a machine is provided. The machine includes a frame and an implement movably coupled to the frame. The implement is configured to selectively engage with a work surface to perform an operation. The machine further includes a positioning module disposed on the frame to determine a location of the machine and a sensor module associated with the implement of the machine. The machine further includes a controller disposed in communication with the positioning module and the sensor module. The controller is configured to determine a start location and an end location of the operation and determine an operating path based on the start location and the end location. The controller is further configured to engage the implement with the work surface and move the machine from the start location along the operating path to perform the operation. The controller is further configured to determine a load acting on the implement based on signals received from the sensor module and determine an interrupted location of the machine based on signals received from the positioning module and the load acting on the implement. The interrupted location corresponds to a location at which the implement is disengaged from the work surface. The controller is further configured to resume the operation of the machine from the interrupted location if a first distance between the interrupted location and the start location is greater than a first threshold distance and a second distance between the interrupted location and the end location is greater than a second threshold distance.

Other features and aspects of this disclosure will be apparent from the following description and the accompanying drawings.

DETAILED DESCRIPTION

Reference will now be made in detail to specific aspects or features, examples of which are illustrated in the accompanying drawings. Wherever possible, corresponding or similar reference numbers will be used throughout the drawings to refer to the same or corresponding parts.

Figure 1:
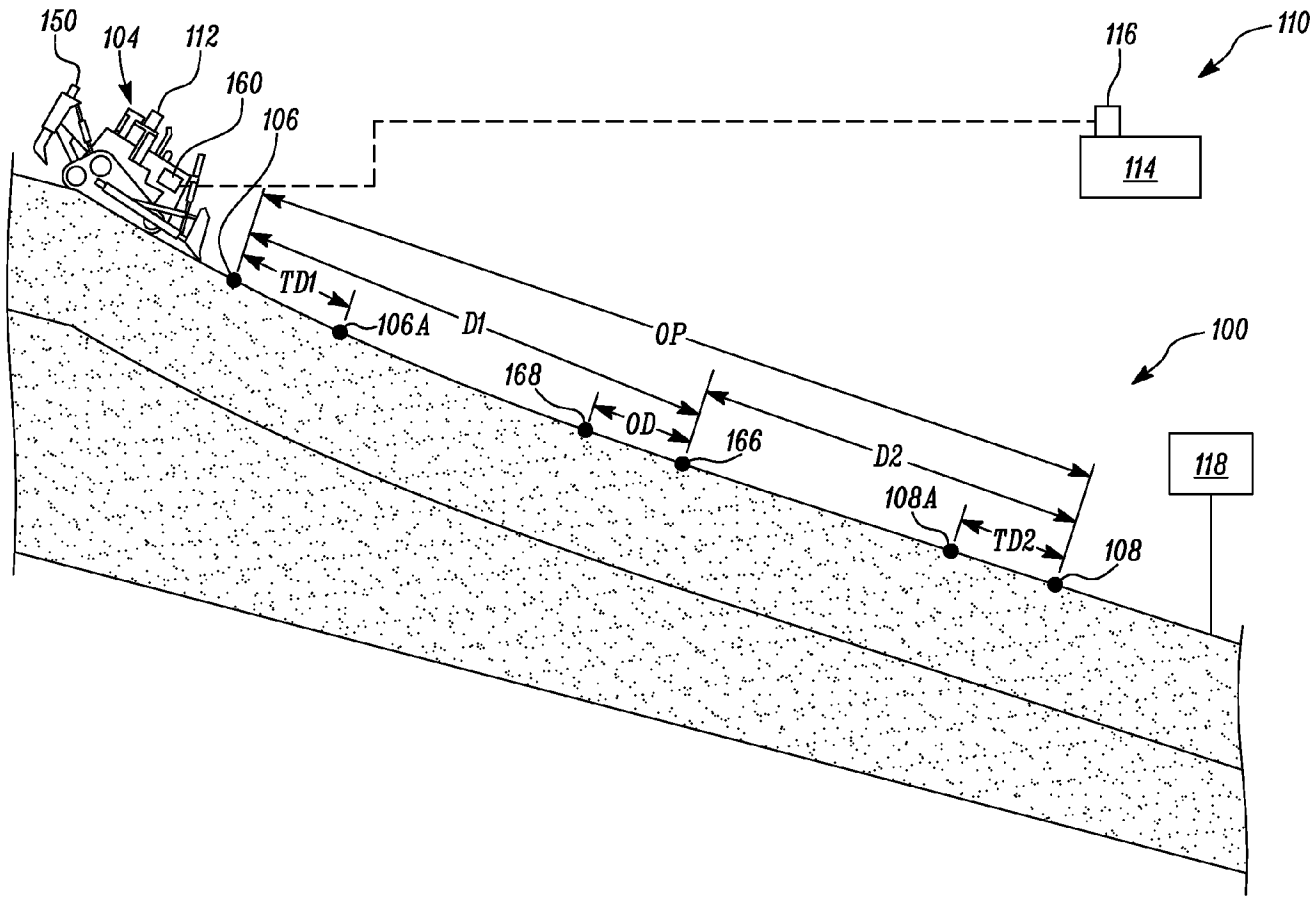
FIG. 1 is a schematic side view of an exemplary worksite and a machine for operating in the worksite, according to an aspect of the current disclosure.

FIG. 1 illustrates a schematic side view of a worksite 100 including a work surface 102. A steep grade work surface is shown in the FIG. 1. However, it may be contemplated that the work surface 102 may be a plane or may be any type of terrain. The worksite 100 may be a portion of a mining site, a landfill, a quarry, a construction site, a road worksite, a forest, a farm, or any other area in which movement of material is desired.

In the illustrated aspect of the current disclosure, a machine 104, such as a dozer may be configured to perform a ripping operation and a cutting operation on the work surface 102. In other aspects of the current disclosure, the machine 104 may be an off-highway vehicle, such as an excavator, a backhoe, a loader, a motor grader, or any other vehicle for performing various earth moving operations. The earth moving operations may include a dozing operation, a grading operation, a leveling operation, a bulk material removal operation, or any other type of operation that may result in altering a topography of the worksite 100. Multiple machines 104 may be used to operate in the worksite 100 for performing such earth moving operations. The machine 104 may be further configured to be controlled in an autonomous mode, a semi-autonomous mode, or a manual mode.

In the illustrated aspect of the current disclosure, a ripping operation of the machine 104 is discussed in detail herein below for illustration purpose of the current disclosure. Further, the machine 104 is configured to perform the ripping operation in the autonomous mode from a start location 106 in the worksite 100 to an end location 108 in the worksite 100. The machine 104 includes a system 110 for controlling the ripping operation thereof in the autonomous mode. However, the system 110 may be configured to control the machine 104 in the semi-autonomous mode or the manual mode.

The system 110 includes a positioning module 112 disposed on the machine 104 to determine a location of the machine 104 in the worksite 100. In the illustrated aspect of the current disclosure, the positioning module 112 includes a satellite positioning device, such as a Global Positioning Satellite (GPS) receiver. The positioning module 112 is disposed on top of the machine 104 to receive signals indicative of the location of the machine 104 in the worksite 100. In other aspects of the current disclosure, the positioning module 112 may be disposed at any location in the machine 104 to receive signals from the GPS Satellites without any obstruction.

In the autonomous mode, the machine 104 is controlled by an operator from a command center 114 located remotely from the worksite 100. In such a case, the system 110 is configured to be in communication with the command center 114 via a wireless network system 116. Further, the system 110 is configured to receive signals indicative of an input from the operator through the wireless network system 116. In another aspect of the current disclosure, a control console 118 may be located within the worksite 100 remotely from the machine 104 to control various operations, such as the ripping operation of the machine 104 via a wired network or a wireless network system. Thus the machine 104 may be controlled in the autonomous mode or the semi-autonomous mode from the command center 114 and/or via the control console 118.

Figure 2:
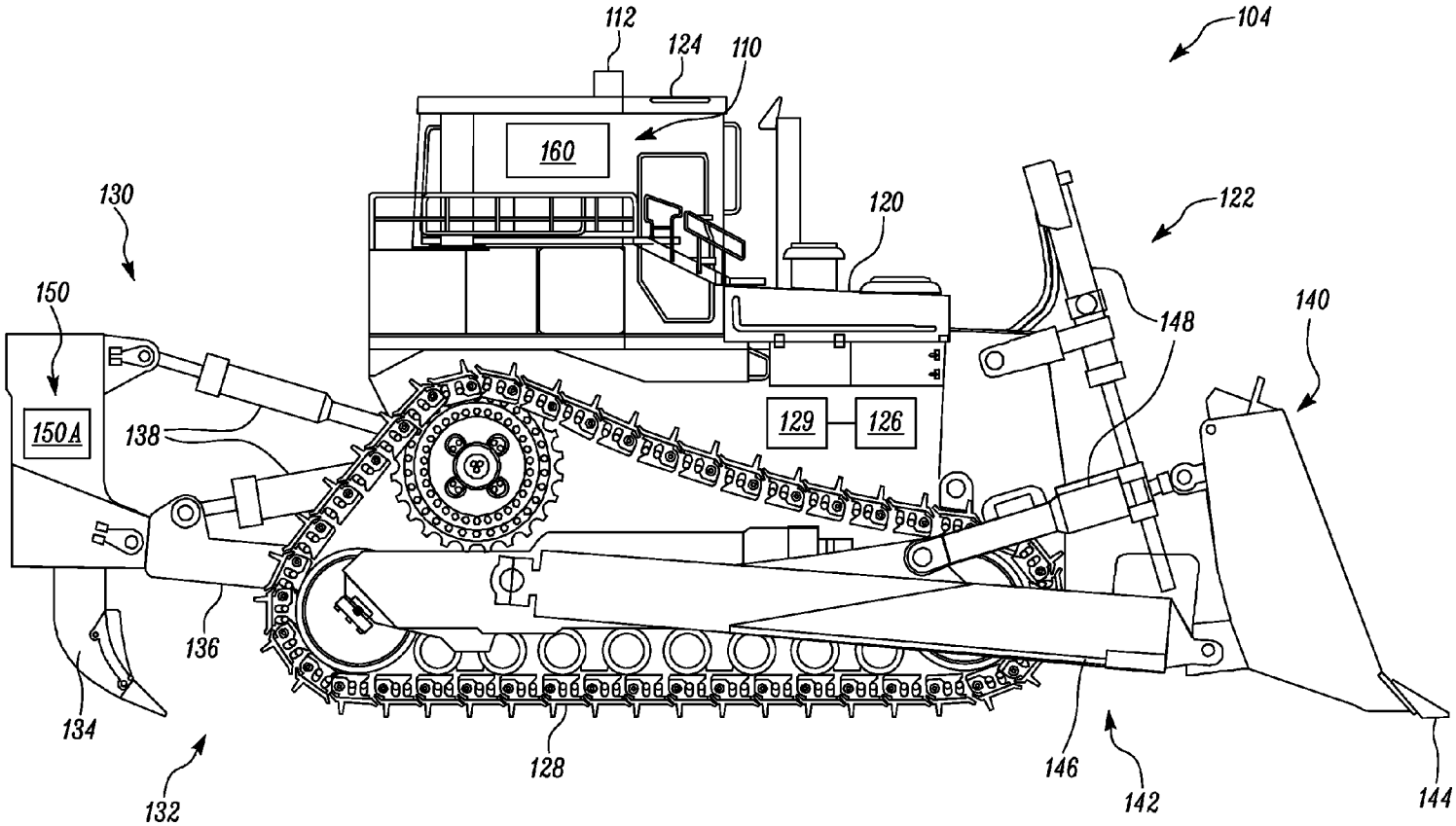
FIG. 2 is a side view of the machine including a system for controlling an operation of the machine, according to an aspect of the current disclosure.

FIG. 2 illustrates a side view of the machine 104 including the system 110 for controlling the ripping and cutting operations of the machine 104, according to an aspect of the current disclosure. The machine 104 includes a frame 120 for supporting various components of the machine 104 including one or more implements 122, an operator cab 124 and an engine 126. The machine 104 further includes a ground engaging member 128 to engage with the work surface 102 and facilitate movement of the machine 104 along the work surface 102 to perform the ripping and cutting operations. The ground engaging member 128 is supported from the frame 120 and receives a driving power from the engine 126 to propel the machine 104. In the illustrated aspect of the current disclosure, the ground engaging member 128 is a pair of tracks. In other embodiments, the ground engaging member 128 may include a plurality of wheels. The engine 126 may be disposed at any location in the frame 120 to supply power to various systems of the machine 104, such as a hydraulic system 129. The hydraulic system 129 is in fluid communication with the one or more implements 122 for performing the ripping and cutting operations. The operator cab 124 may include multiple control levers and/or switches for controlling movement of the machine 104 and ripping and cutting operations of the machine 104. In the illustrated aspect of the current disclosure, the system 110 is disposed within the operator cab 124. However, the system 110 may be disposed at any location in the machine 104 to control ripping and cutting operations of the machine 104.

The implements 122 are configured to selectively engage with the work surface 102 for performing the ripping and cutting operations. As shown in FIG. 2, the machine 104 includes a first implement 130, such as a ripper, movably coupled to the frame 120 at a rear end 132 of the machine 104. The first implement 130 is configured to engage with the work surface 102 for digging into the work surface 102 and for mixing and/or loosening soil in the work surface 102. The first implement 130 includes one or more ripper shanks 134 coupled to the frame 120 via a linkage 136. The ripper shank 134 may be pivotally coupled to the linkage 136. The ripper shank 134 and the linkage 136 are further actuated by individual actuators 138, such as hydraulic cylinders for moving the ripper shank 134 relative to the frame 120. The actuators 138 may be in fluid communication with the hydraulic system 129.

The machine 104 further includes a second implement 140, such as a cutting tool, movably coupled to the frame 120 at a front end 142 of the machine 104. The second implement 140 is configured to engage with the work surface 102 for cutting into the work surface 102 and hence to level the work surface 102. The second implement 140 includes a blade 144 pivotally coupled to the frame 120 via a linkage 146. The blade 144 is further actuated by one or more actuators 148, such as hydraulic cylinders for moving the first implement 130 relative to the frame 120. The actuators 148 may be in fluid communication with the hydraulic system 129.

In an exemplary aspect, the hydraulic system 129 may include one or more control valves for selectively allowing fluid to flow into the actuators 138, 148 to control movement of the first and second implements 130, 140, respectively. The hydraulic system 129 may be further communicated with the system 110 for receiving signals indicative of inputs related to the ripping operation and the cutting operation.

The system 110 further includes a sensor module 150 configured to generate signals indicative of various operating parameters of the machine 104 and the implements 122. In the illustrated aspect of the current disclosure, the sensor module 150 includes a load sensor 150A disposed in the first implement 130 to generate signals indicative of a load acting on the first implement 130. In another embodiment, the load sensor 150A may be associated with the actuators 138 or the hydraulic system 129 of the machine 104 to generate signals indicative of the load acting on the first implement 130.

In other aspects of the current disclosure, the sensor module 150 may include one or more movement sensors disposed in the machine 104 for generating signals indicative of movement of the machine 104. Further, one or more additional sensors may be disposed in the engine 126 to generate signals indicative of various operating parameters of the engine 126, such as a speed of the engine 126, an oil pressure, an oil temperature, and the like. Such various operating parameters of the machine 104 and the engine 126 may also be used for determining the load acting on the first implement 130.

The system 110 further includes a controller 160 disposed in the machine 104 to control various operations of the machine 104 including the ripping and cutting operations. The controller 160 is disposed within the operator cab 124 and configured to be in communication with the positioning module 112 and the sensor module 150. Specifically, the controller 160 is configured to be in communication with the sensor module 150 to receive signals generated by the load sensor 150A and the sensors located in the machine 104 and the engine 126 to determine various operating parameters of the machine 104, the engine 126 and the implements 122. Further, the controller 160 is configured to be in communication with the positioning module 112 to receive signals from the positioning module 112 and to determine the location of the machine 104 in the worksite 100.

In the autonomous mode, the controller 160 is configured to be in communication with the command center 114 via the wireless network system 116 to receive signals indicative of the operator inputs. In another aspect of the current disclosure, the controller 160 may be configured to be in communication with the control console 118 to receive signals indicative of the operator input to control the operations of the machine 104. In the manual mode, the controller 160 may receive inputs from the operator located within the operator cab 124.

In various embodiments, the controller 160 may control operations of various systems of the machine 104, such as a transmission system, an electric system and the hydraulic system 129. The controller 160 may also be configured to be in communication with the sensors disposed in the machine 104 and the engine 126 to determine various operating parameters of the machine 104 and the engine 126, respectively.

Figure 3:
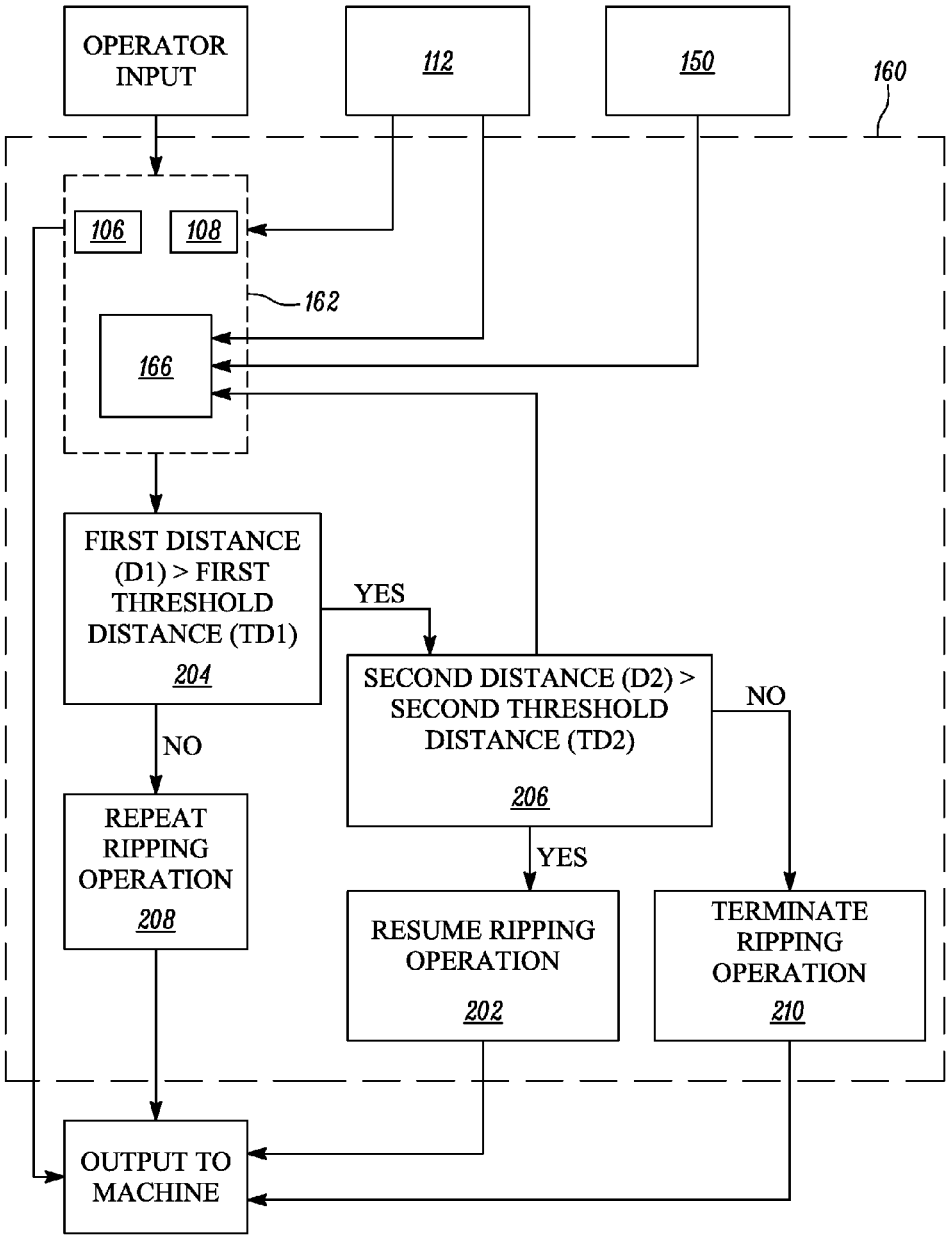
FIG. 3 is a block diagram illustrating a controller of the system, according to an aspect of the current disclosure.
Figure 4:
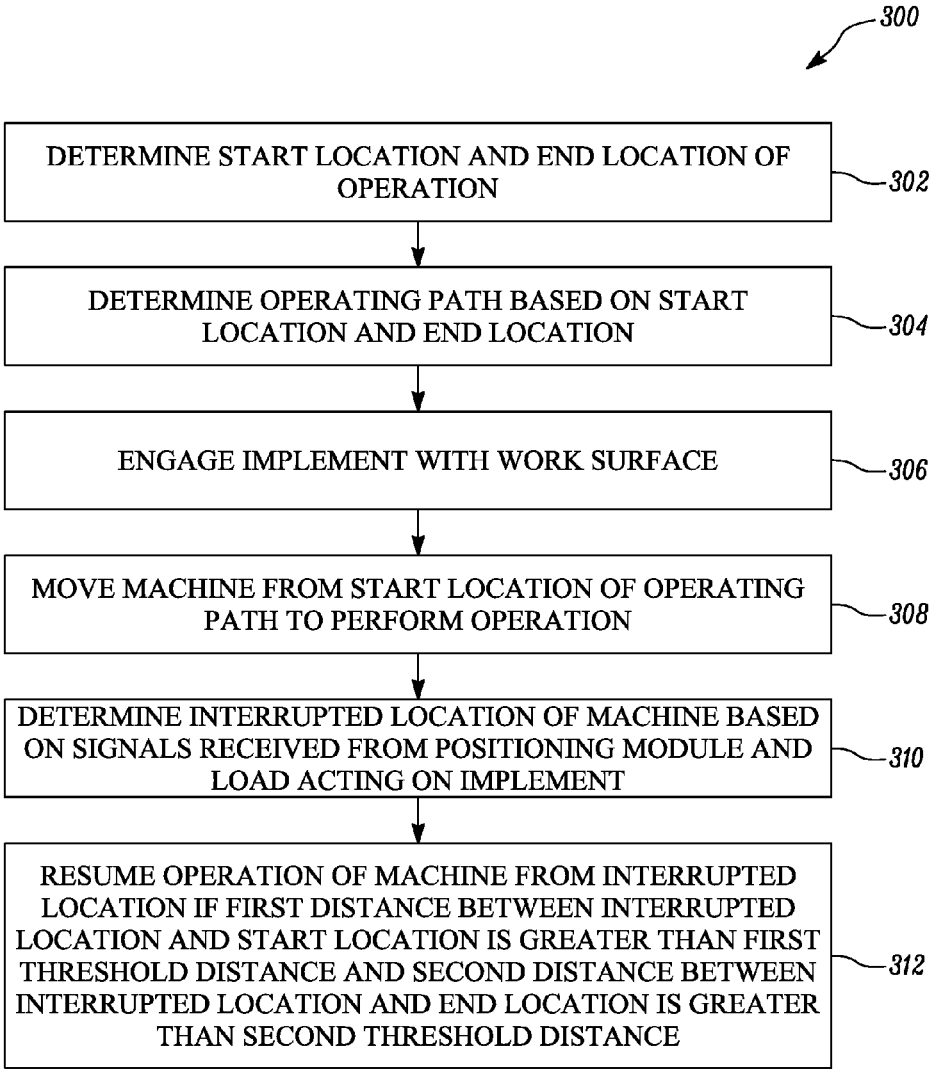
FIG. 4 is a flowchart of a method of controlling the operation of the machine, according to an aspect of the current disclosure.

FIG. 3 is a block diagram illustrating the controller 160 of the system 110, according to an aspect of the current disclosure. Function of the controller 160 is described in detail herein below with reference to the ripping operation of the machine 104. Also, the first implement 130 is hereinafter referred as 'the implement 130'.

The controller 160 includes a memory module 162 configured to store various input and output data, such as the start location 106 and the end location 108 of the ripping operation. In the autonomous mode, referring to FIGS. 1 and 3, the controller 160 is in communication with the positioning module 112 to determine a plurality of locations of the machine 104 in the worksite 100 based on the signals received from the positioning module 112. Further, the controller 160 is in communication with the command center 114 to receive a signal 'S1' indicative of the operator input to determine the start location 106 and the end location 108 for the ripping operation. The operator may determine the start location 106 and the end location 108 within the worksite 100 based on the terrain of the worksite 100 to be levelled or material to be removed from a portion of the worksite 100. The determined start location 106 and the end location 108 are stored in the memory module 162.

The controller 160 is further configured to determine an operating path 'OP' between the start location 106 and the end location 108 in the worksite 100 based on the operator input. The operating path 'OP' may correspond to a path determined by the controller 160 between the start location 106 and the end location 108 to guide the machine 104 travel along the path for performing the ripping operation.

In the autonomous mode, after determining the operating path 'OP', the controller 160 is further configured to engage the implement 130 with the work surface 102. The implement 130 is engaged with the work surface 102 at the start location 106 of the operating path 'OP'. The controller 160 in communication with the hydraulic system 129 of the machine 104 may actuate the control valves to control flow of fluid into the actuators 138 of the implement 130. Based on the flow of fluid, the ripper shank 134 moves downward relative to the frame 120 to engage with the work surface 102. The ripper shank 134 is further dug into the work surface 102 at a desired depth with reference to the work surface 102. The desired depth of ripping of the work surface 102 may be determined based on one or more positions sensors disposed in the implement 130. The controller 160 is further configured to move the machine 104 from the start location 106 along the operating path 'OP' for performing the ripping operation in the work surface 102. As the machine 104 moves along the operating path 'OP', the implement 130 breaks the work surface 102 and makes the soil loose.

Further, the controller 160 is configured to determine a plurality of locations of the machine 104 along the operating path 'OP' starting from the start location 106 based on the signals received from the positioning module 112. The determined plurality of locations of the machine 104 is further stored in the memory module 162. In an exemplary aspect, the controller 160 may be further configured to determine a ripping pass of the machine 104 starting from the start location 106 based on the stored plurality of locations of the machine 104 along the operating path 'OP'. The ripping pass may correspond to a distance travelled by the machine 104 from the start location 106 along the operating path 'OP'.

Simultaneously, the controller 160 is configured to determine the load acting on the implement 130 based on signals received from the sensor module 150. The controller 160 in communication with the load sensor 150A receives signals generated by the load sensor 150A to determine the load acting on the implement 130. In an example, as the ripper shank 134 engages with the work surface 102 during the movement of the machine 104 along the operating path 'OP', the work surface 102 may apply an opposing load on the implement 130. The load may vary based on various parameters including, but not limited to, hardness of the work surface 102, a speed of the machine 104 and a slope of the work surface 102. Thus, the load acting on the implement 130 may also be determined based on the various operating parameters of the machine 104, the engine 126 and the hydraulic system 129, or a combination thereof.

The controller 160 is configured to determine an interrupted location 166 of the machine 104 based on the signals received from the positioning module 112 and the sensor module 150. The interrupted location 166 corresponds to a location at which the implement 130 is disengaged from the work surface 102. During the ripping operation, if the work surface 102 is hard and unable to perform the ripping operation, then the ripper shank 134 of the implement 130 may come out of the work surface 102 and moves upward relative to the frame 120. In an example, if the load acting on the implement 130 exceeds beyond a threshold load, then the controller 160 may disengage the implement 130 from the work surface 102 to safeguard the machine 104 from damages. Once the implement 130 is disengaged from the work surface 102, the load acting on the implement becomes zero. Thus, the controller 160 is configured to determine whether the implement 130 is disengaged from the work surface 102. In other aspects of the current disclosure, the disengaged condition of the implement 130 while performing the ripping operation along the operating path 'OP' may be determined based on various parameters including, but not limited, to a position of the implement 130 relative to the frame 120, and various operating parameters of the machine 104, the engine 126, and the hydraulic system 129. If there is no reason for emergency stoppage of the machine 104 or disengagement of the implement 130 from the work surface 102, then the controller 160 may control the machine 104 to perform the ripping operation till the end location 108 in a single ripping pass.

The location at which the implement 130 disengaged from the work surface 102 is further determined based on the positioning module 112. In an example, the interrupted location 166 may be determined by a relationship between the plurality of locations of the machine 104 determined by the controller 160 and the corresponding load acting on the implement 130 at the particular location. In other aspects of the current disclosure, various relationships may be defined with reference to various operating parameters of the machine 104, the implement 130, the engine 126 and the plurality of locations of the machine 104 to determine the interrupted location 166 of the machine 104 in the operating path 'OP'.

At the interrupted location 166, the machine 104 comes out of the autonomous mode. Simultaneously, the controller 160 may alarm the operator located at the command center 114 that the machine 104 is stopped as the implement 130 is disengaged from the work surface 102. Further, the ripping operation of the machine 104 may stop at the interrupted location 166. The interrupted location 166 of the machine 104 is further stored in the memory module 162. It may also be contemplated that the machine 104 may come out of the autonomous mode due to various reasons, including machine-breakdown or surrounding obstacles such as a rock.

After receiving the alarm from the machine 104, the operator may clear the reasons for such stoppage of the machine 104. The operator may further put the machine 104 in the autonomous mode to perform the ripping operation along the operating path 'OP'.

Referring to FIGS. 1 to 3, at step 202, as soon as the controller 160 receives signals indicative of the operator input to start the ripping operation in the autonomous mode, the controller 160 controls the machine 104 to resume the ripping operation from the interrupted location 166 if a first distance 'D1' between the interrupted location 166 and the start location 106 is greater than a first threshold distance 'TD1', as shown at step 204, and a second distance 'D2' between the interrupted location 166 and the end location 108 is greater than a second threshold distance 'TD2', as shown at step 206. The first distance 'D1' may be determined along the operating path 'OP' from the start location 106 and the interrupted location 166. The first distance 'D1' may further correspond to a length of a ripping pass of the machine 104 along the operating path 'OP'. In an example, the first distance 'D1' may be determined by the controller 160 based on a mathematical relationship between the start location 106 and the interrupted location 166.

The first threshold distance 'TD1' may be a distance predefined with respect to the start location 106 along the operating path 'OP'. The first threshold distance 'TD1' may be defined after determining the start location 106 of the operating path 'OP'. The first threshold distance 'TD1' may also be defined by the controller 160 based on an input from the operator before start of the ripping operation. The first threshold distance 'TD1' is further stored in the memory module 162 of the controller 160. In another aspect of the current disclosure, the first threshold distance 'TD1' may define a first threshold location in the operating path 'OP' with respect to the start location 106.

Similarly, the second distance 'D2' may be determined along the operating path 'OP' from the end location 108 and the interrupted location 166. In an example, the second distance 'D2' may be determined by the controller 160 based on a mathematical relationship between the end location 108 and the interrupted location 166. The second threshold distance 'TD2' may be a distance predefined with respect to the end location 108 of the operating path 'OP'. The second threshold distance 'TD2' may be defined by the controller 160 based on an input from the operator. The second threshold distance 'TD2' may also be defined after determining the end location 108 of the operating path 'OP'. The second threshold distance 'TD2' may be further stored in the memory module 162. In another aspect of the current disclosure, the second threshold distance 'TD2' may define a second threshold location in the operating path 'OP' with respect to the end location 108.

In an alternative embodiment, the controller 160 may be configured to resume the ripping operation of the machine 104 if the interrupted location 166 falls within the first threshold location and the second threshold location. The controller 160 may determine the interrupted location 166 based on a mathematical relationship between the interrupted location 166, and the first and second threshold locations.

In an aspect of the current disclosure, the controller 160 is further configured to determine an offset location 168 with reference to the interrupted location 166 based on the stored plurality of locations of the machine 104 in the memory module 162. The offset location 168 is located between the start location 106 and the interrupted location 166 at an offset distance 'OD' from the interrupted location 166. The controller 160 is further configured to resume the ripping operation of the machine 104 from the offset location 168 in the operating path 'OP'. The offset distance 'OD' may be a distance predetermined with reference to the interrupted location 166. In another aspect of the current disclosure, the offset location 168 may be determined based on the ripping pass of the machine 104 along the operating path 'OP'.

The controller 160 is further configured to repeat the ripping operation of the machine 104, as shown at step 208, from the start location 106 if the first distance 'D1' is less than or equal to the first threshold distance 'TD1'. If the first distance 'D1' determined between the start location 106 and the interrupted location 166 is less than the first threshold distance 'TD1', then the machine 104 may start the ripping operation from the start location 106 and end the ripping operation at the end location 108. In another aspect of the current disclosure, the controller 160 may determine if the interrupted location 166 falls within the first threshold location 106A and the start location 106 based on a relationship between the interrupted location 166, the start location 106 and the first threshold location 106A.

The controller 160 is further configured to terminate the ripping operation of the machine 104, as shown at step 210, if the second distance 'D2' is less than or equal to the second threshold distance 'TD2'. If the second distance 'D2' determined between the end location 108 and the interrupted location 166 is less than the second threshold distance 'TD2', then the machine 104 may terminate the ripping operation. Further, the controller 160 may delete the ripping pass of the machine 104 from the memory module 162. In another aspect of the current disclosure, the controller 160 may determine if the interrupted location 166 falls between the end location 108 and the second threshold location 108A based on a relationship between the interrupted location 166, the end location 108 and the second threshold location 108A. The machine 104 may be further controlled to perform the cutting operation if the interrupted location 166 falls between the end location 108 and the second threshold location 108A.

INDUSTRIAL APPLICABILITY

The current disclosure relates to the system 110 and a method 300 for controlling the ripping operation of the machine 104 in the autonomous mode. The system 110 includes the positioning module 112, the sensor module 150 and the controller 160 to determine the start location 106 and the end location 108 of the operating path 'OP' for performing the ripping operation. The interrupted location 166 is also determined if the machine 104 comes out of the autonomous mode during the ripping operation. The ripping operation of the machine 104 is further controlled in the autonomous mode to resume the ripping operation from the interrupted location 166 if the interrupted location 166 falls between the first threshold location 106A and the second threshold location 108A in the operating path 'OP'.

At step 302, the method 300 includes determining the start location 106 and the end location 108 of the ripping operation. The controller 160 in communication with the positioning module 112 determines the plurality of locations of the machine 104 in the worksite 100. The controller 160 further receives inputs from the operator to determine the start location 106 and the end location 108. At step 304, the method 300 includes determining the operating path 'OP' based on the start location 106 and the end location 108. The controller 160 determines the operating path 'OP' based on the inputs received from the positioning module 112 and the operator. The operating path 'OP' may be further determined based on a terrain of the work surface 102 in the worksite 100.

At step 306, the method 300 includes engaging the implement 130 with the work surface 102. As the machine 104 is actuated in the autonomous mode, the ripper shank 134 of the implement 130 engages with the work surface 102 at the start location 106. The hydraulic system 129 in communication with the controller 160 may actuate the actuators 138 to engage the implement 130 with the work surface 102. At step 308, the method 300 includes moving the machine 104 from the start location 106 to perform the ripping operation along the operating path 'OP'. The controller 160 may control the movement of the machine 104 along the operating path 'OP' such that the implement 130 may break the work surface 102 and loosen the soil. In an aspect of the current disclosure, the controller 160 determines the plurality of locations of the machine 104 in the operating path 'OP' and may determine the ripping pass. The ripping pass may be further stored in the memory module 162.

At step 310, the method 300 includes determining the interrupted location 166 of the machine 104 based on signals received from the positioning module 112 and the load acting on the implement 130. In another aspect of the current disclosure, the controller 160 in communication with the sensor module 150 receives signals indicative of the various operating parameters of the machine 104, the engine 126 and the implements 122. Further, the controller 160 determines the load acting on the implement 130. In an example, if the load acting on the implement 130 is zero, then the controller 160 may determine that the implement is disengaged from the work surface 102. Further, the machine 104 may stop and come out of the autonomous mode. The controller 160 in communication with the positioning module 112 further determines the interrupted location 166 and store the location in the memory module 162.

At step 312, the method 300 includes resuming the operation of the machine 104 from the interrupted location 166 if the first distance 'D1' is greater than the first threshold distance 'TD1' and the second distance 'D2' is greater than the second threshold distance 'TD2'. The method 200 further includes determining the offset location 168 and resuming the ripping operation from the offset location 168. In another aspect of the current disclosure, the method 300 includes repeating the ripping operation from the start location 106 if the first distance 'D1' is less than or equal to the first threshold distance 'TD1'. In yet another embodiment, the method 300 includes terminating the ripping operation if the second distance 'D2' is less than or equal to the second threshold distance 'TD2'.

According to the current disclosure, the operator may control one or more machines 104 in the autonomous mode from a remote center without any difficulty, as the machines 104 are configured to perform the ripping operation from the start location 106 to the end location 108 along the operating path 'OP' even any interruption occurs during the ripping operation. Further, productivity of the machine 104 may be improved as the machine 104 is controlled to resume the ripping operation from the interrupted location 166, instead of repeating the ripping operation that is already performed along the operating path 'OP', if any interruption occurs during the ripping operation. Further, less man power and effort may be required for operating multiples machines 104 in the worksite 100. Efficiency of the ripping operation may also be improved as repetition of the ripping operation on the work surface 102 is eliminated.

While aspects of the current disclosure have been particularly shown and described above, it will be understood by those skilled in the art that various additional aspects may be contemplated by the modification of the disclosed machines, systems and methods without departing from the spirit and scope of what is disclosed. Such aspects should be understood to fall within the scope of the current disclosure as determined based upon the claims and any equivalents thereof.

What is claimed is:

1. A system for controlling an operation of a machine having an implement configured to selectively engage with a work surface to perform the operation, the system comprising:

a positioning module disposed on the machine to determine a location of the machine;

a sensor module associated with the implement of the machine; and a controller disposed in communication with the positioning module and the sensor module, the controller configured to:

store a start location and an end location of the operation;

determine an operating path based on the start location and the end location;

engage the implement with the work surface and move the machine from the start location along the operating path to perform the operation;

determine a load acting on the implement based on signals received from the sensor module;

determine an interrupted location of the machine based on signals received from the positioning module and the load acting on the implement, wherein the interrupted location corresponds to a location at which the implement is disengaged from the work surface; and resume the operation of the machine from the interrupted location if a first distance between the interrupted location and the start location is greater than a first threshold distance and a second distance between the interrupted location and the end location is greater than a second threshold distance.

2. The system of claim 1, wherein the controller comprises a memory module configured to store the start location, the end location, the first threshold distance and the second threshold distance, wherein the first threshold distance is defined with respect to the start location of the operating path, and wherein the second threshold distance is defined with respect to the end location of the operating path.

3. The system of claim 2, wherein the controller is further configured to:

determine a plurality of locations of the machine based on signals received from the positioning module as the machine moves along the operating path while performing the operation; and store the determined locations of the machine in the memory module.

4. The system of claim 3, wherein the controller is further configured to:

determine an offset location with reference to the interrupted location based on the stored locations of the machine, wherein the offset location is located between the start location and the interrupted location at an offset distance from the interrupted location; and resume the operation of the machine from the offset location.

5. The system of claim 1, wherein the controller is further configured to repeat the operation of the machine from the start location of the operating path if the first distance is less than or equal to the first threshold distance.

6. The system of claim 1, wherein the controller is further configured to terminate the operation of the machine if the second distance is less than or equal to the second threshold distance.

7. The system of claim 1, wherein the positioning module comprises a satellite positioning device.

8. The system of claim 1, wherein the sensor module comprises a load sensor configured to be in communication with the controller, wherein the load sensor is configured to generate signals indicative of the load acting on the implement.

9. A method of controlling an operation of a machine having an implement configured to selectively engage with a work surface to perform the operation, the method comprising:

storing a start location and an end location of the operation;

determining an operating path based on the start location and the end location;

engaging the implement with the work surface;

moving the machine from the start location of the operating path to perform the operation;

determining an interrupted location of the machine based on signals received from a positioning module and a load acting on the implement, wherein the interrupted location corresponds to a location at which the implement is disengaged from the work surface; and resuming the operation of the machine from the interrupted location if a first distance between the interrupted location and the start location is greater than a first threshold distance and a second distance between the interrupted location and the end location is greater than a second threshold distance.

10. The method of claim 9 further comprising:

determining a plurality of locations of the machine based on signals received from the positioning module as the machine moves along the operating path while performing the operation; and storing the determined locations of the machine in a memory module associated with a controller.

11. The method of claim 10 further comprising:

determining an offset location with reference to the interrupted location based on the stored locations of the machine, wherein the offset location is located between the start location and the interrupted location at an offset distance from the interrupted location; and resuming the operation of the machine from the offset location.

12. The method of claim 9 further comprising repeating the operation of the machine from the start location if the first distance is less than or equal to the first threshold distance.

13. The method of claim 9 further comprising terminating the operation of the machine if the second distance is less than or equal to the second threshold distance.

14. A machine comprising:

a frame;

an implement movably coupled to the frame, the implement configured to selectively engage with a work surface to perform an operation;

a positioning module disposed on the frame to determine a location of the machine;

a sensor module associated with the implement of the machine; and a controller disposed in communication with the positioning module and the sensor module, the controller configured to:

store a start location and an end location of the operation;

determine an operating path based on the start location and the end location;

engage the implement with the work surface and move the machine from the start location along the operating path to perform the operation;

determine a load acting on the implement based on signals received from the sensor module;

determine an interrupted location of the machine based on signals received from the positioning module and the load acting on the implement, wherein the interrupted location corresponds to a location at which the implement is disengaged from the work surface; and resume the operation of the machine from the interrupted location if a first distance between the interrupted location and the start location is greater than a first threshold distance and a second distance between the interrupted location and the end location is greater than a second threshold distance.

15. The machine of claim 14, wherein the controller comprises a memory module configured to store the start location, the end location, the first threshold distance and the second threshold distance, wherein the first threshold distance is defined with respect to the start location of the operating path, and wherein the second threshold distance is defined with respect to the end location of the operating path.

16. The machine of claim 15, wherein the controller is further configured to:

determine a plurality of locations of the machine based on signals received from the positioning module as the machine moves along the operating path while performing the operation; and store the determined locations of the machine in the memory module.

17. The machine of claim 16, wherein the controller is further configured to:

determine an offset location with reference to the interrupted location based on the stored locations of the machine, wherein the offset location is located between the start location and the interrupted location at an offset distance from the interrupted location; and resume the operation of the machine from the offset location.

18. The machine of claim 14, wherein the controller is further configured to repeat the operation of the machine from the start location if the first distance is less than or equal to the first threshold distance.

19. The machine of claim 14, wherein the controller is further configured to terminate the operation of the machine if the second distance is less than or equal to the second threshold distance.

20. The machine of claim 14, wherein the sensor module comprises a load sensor configured to be in communication with the controller, wherein the load sensor is configured to generate signals indicative of the load acting on the implement.

* * * * *